US006756353B1

(12) United States Patent
Pettifer et al.

(10) Patent No.: US 6,756,353 B1
(45) Date of Patent: Jun. 29, 2004

(54) DETERGENT COMPOSITIONS OR COMPONENTS

(75) Inventors: Robert Michael Pettifer, Tyne & Wear (GB); Victor Stuart Reid, Newcastle upon Tyne (GB); Paul Sherrington, Newcastle upon Tyne (GB); Shirley Summers, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 127 days.

(21) Appl. No.: 09/980,795

(22) PCT Filed: Jun. 26, 2000

(86) PCT No.: PCT/US00/17532

§ 371 (c)(1),
(2), (4) Date: Dec. 3, 2001

(87) PCT Pub. No.: WO01/02526

PCT Pub. Date: Jan. 11, 2001

(30) Foreign Application Priority Data

Jul. 1, 1999 (GB) ..... 9915345

(51) Int. Cl.[7] ..... C11D 3/22; C11D 3/37

(52) U.S. Cl. ..... 510/473; 510/438; 510/443; 510/444; 510/446; 510/452; 510/470

(58) Field of Search ..... 510/438, 443, 510/444, 446, 452, 470, 473

(56) References Cited

U.S. PATENT DOCUMENTS 6,384,011 B1 * 5/2002 Leupin et al. ..... 510/473
6,630,436 B1 * 10/2003 York et al. ..... 510/392

FOREIGN PATENT DOCUMENTS

| | | | | |
|---|---|---|---|---|
| WO | WO 98/28339 | * | 7/1998 | ..... C08F/2/20 |
| WO | WO 99/14295 | * | 3/1999 | ..... C11D/3/22 |
| WO | WO 01/02526 | * | 1/2001 | ..... C11D/3/22 |

OTHER PUBLICATIONS

R. J. Jones, Processes For Making A Granular Detergent Composition Containing Modified Carboxy Methyl Cellulose, U.S. Application 60/113306, filed Dec. 22, 1998.

* cited by examiner

*Primary Examiner*—Brian P. Mruk
(74) *Attorney, Agent, or Firm*—Julie A. Glazer; Brahm J. Corstanje; Kim William Zerby

(57) ABSTRACT

Detergent compositions or components are formulated with certain hydrophobically modified cellulosic materials, which provide protection of fabrics, whereof at least 80% or even at least 90% have a particle size of below 1000 microns or even below 850 or even 710 microns. Selection of materials of this particle size results in improved dispersability of the cellulosic material and imparts improved appearance and integrity benefits to fabrics and textiles laundered in washing solutions from such compositions.

2 Claims, No Drawings

DETERGENT COMPOSITIONS OR COMPONENTS

TECHNICAL FIELD

The present invention relates to detergent compositions or components comprising certain hydrophibically modified cellulosic materials, which provides protection of fabrics, of a specific particle size and preferably particle size distribution.

BACKGROUND OF THE INVENTION

It is generally known that fabrics and textiles tend to wear out over time, due to mechanical action during washing but also in use. For example, short fibers are dislodged from the fabric and may form lint, fuzz or "pills" which are visible on the surface of fabrics and diminish the appearance of newness of the fabric. Co-pending application PCT/US98/19139 describes the use of hydrophobically modified cellulosic polymers which are found to provide excellent integrity benefits to fabrics. Without wishing to be bound by theory, it is believed that these materials associate themselves with the fibers of the fabrics and textiles during the wash and thereby reduce or minimize the tendency of the laundered fabric/textiles to deteriorate in appearance.

These materials are not readily water-soluble and the delivery to the wash and to the fabrics thus very much depends on the dispersion of the material in the wash water. The inventors have found that under certain conditions, these hydrophobically modified cellulosic polymers are not always dispersed satisfactory, resulting in reduced performance and moreover localised residues of the material on the fabrics. Furthermore, the inventors also found that under certain conditions other detergent ingredients can become entrapped in the cellulosic material, causing further residue problems, or even reduced performance of these other ingredients.

The inventors have now found that when hydrophobically modified cellulosic material of a specific particle size is used, these problems can be reduced or even avoided. They found that when the selected material, preferably having a particle size of below 1000 microns, or even below 710 microns or even below 500 microns improved dispersion of the material is obtained, and furthermore improved dispersion or dissolution of other detergent ingredients being in close contact with the polymers. They also found that hereby an improved efficiency of the hydrophobically modified cellulose material is obtained and thus an improved fabric integrity. They also found that it may hereby be preferred that the material has a narrow particle size distnbution.

Co-pending application U.S. Pat. No. 60/113,306 describes that these hydrophobically modified materials materials may be formed into agglomerates, for example with builders such as zeolite, and then incorporated into detergent compositions. The inventors have now found that when hydrophobically modified cellulose polymers of selected particle size are incorporated in these pre-formed particles, such as agglomerates but also spray dried blown powders, also improved dispersion or dissolution of the preformed particles, and also the ingredient and importantly the cellulose material therein is achieved.

SUMMARY OF THE INVENTION

The present invention relates to a detergent composition or component comprising a hydrophobically modified cellulosic material, whereof at least 80% or even at least 90% or even 100% has a particle size of below 1000 microns, preferably below 850 microns or even below 710 microns.

The hydrophobically modified cellulosic material may be incorporated in the compositions or components as dry-add, and/or the hydrophobically modified cellulosic material may be present in a pre-formed particle such as an agglomerate, spray dried or blown powder or extrudate, together with other detergent ingredients.

The compositions may be laundry detergents or additives, fabric softeners or fabric treatment products. Preferably the compositions or components are solid, preferably granular or in the form of a tablet, however liquid, non-aqueous liquid and gel compositions are also envisaged herein.

The present invention also relates to the laundering or treating of fabrics and textiles in aqueous washing or treating solutions formed from effective amounts of the detergent compositions or components described herein.

DETAILED DESCRIPTION OF INVENTION

Hydrophobically Modified Cellulosic Material and Polymers

The hydrophobically modified cellulosic material, herein also referred to as cellulosic material, are such that at least 80% or even 90% by weight but preferably 100% by weight has a particle size of below 1000 microns. However, it may be preferred that at least 80% by weight or even 90% or even 100% by weight has a particle size of below 850 microns or even below 710 microns or even below 500 microns.

To obtain the benefits of the invention, the exact particle size and the particle size distribution or span of the hydrophobically modified cellulosic material may vary within the specified range, depending on the mode the material is incorporated in the compositions or components and also on the exact nature of the compositions and components.

When the cellulosic material is added as a dry-add, as described herein, it may be preferred that the material has a particle size of between 1 micron to 1000 microns, more preferably 80% having a particle size of from 10 microns to 900 microns, more preferably 80% having a particle size of from 50 or even from 150 or even from 250 microns to 850 or even to 800 or even to 710 microns. The mean particle size of the cellulosic material is then preferably from 100 to 850 microns, more preferably from 250 microns to 800 microns or even from 350 microns to 800 microns.

When the cellulosic material is incorporated in a preformed particle, as described herein, it may be preferred that the material has a particle size of between 0.1 micron to 710 microns, more preferably 80% having a particle size of from 1 micron to 550 microns, more preferably 80% having a particle size of from 2 or even from 10 or even from 25 microns to 500 or even to 450 or even to 350 microns. The mean particle size of the cellulosic material is then preferably from 5 to 500 microns, more preferably from 25 microns to 450 microns or even from 50 microns to 400 microns.

In certain applications, it may be beneficial that the particle size distribution is narrow, for example having a span of 3 or less, preferably 2 or less, even more preferably 1.7 or even 1.5 or less.

As used heron, the phrase "mean particle size" means the geometric mass median diameter of a set of discrete particles as measured by any standard mass-based particle size measurement technique, preferably by dry sieving. As used herein, the "span" of a particle size distribution means the geometric standard deviation, which for example can be calculated by the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{5D}$); See Gotoh et al, *Powder Technology Handbook*, pp. 6–11, Marcel Dekker 1997.

The cellulosic material of the specified particle size can be obtained by any method of selecting material based on particle size. Preferred may be that larger granules of the material are reduced in particle size by grinding or milling, followed by sieving the obtained smaller particles and selecting the required sieve fractions. Other methods are known to the skilled person. It may be preferred that one faction is used as dry-add for the compositions or components herein, and that another fraction is incorporated in preformed particles, as described hereinafter.

Typically, the hydrophobically modified cellulosic material comprises from 40% to 100% of hydrophobically modified polymers described herein after, more preferably from 50% to 99% or even from 60% or even from 70% to 90% by weight of the material. The remaining weight % typically comprises impurities introduced during the making process, such as water, salts, and minor organic compounds which may include alcohols, organic acids or salts thereof, and/or process aids.

Depending on the application of the composition or component herein, the amount of cellulosic material in the compositions or components may very. The cellulosic material will generally be about 0.01% to about 90% by the weight of the detergent composition or component, more preferably from 0.05% to 20% or even from 0.05% to 15% by weight. In detergent compositions herein it may for example be preferred that the cellulosic material is present at a level of from 0.05% to 10% by weight of the detergent composition, preferably from 0.05% to 5% or even from 0.05% to 3% or even 0.1% to 2% by weight. In detergent additives or components, or the preformed particles described herein after, the material may preferably be present at a level of 0.05% to 40% by weight of the component, or even from 0.05% to 20% or even 0.1% to 15% or even 1% to 10% by weight.

The cellulosic material herein is preferably present in the composition or component in such an amount that the concentration of the hydrophobically modified cellulosic polymer in the wash is from 1 ppm to 10,000 ppm, preferably from 10 ppm to 7000 ppm or even from 20 to about 1000 ppm.

The hydrophobically modified cellulosic polymers in the material herein include polymers, oligomers, copolymers and also cross-linked polymers, oligomers and copolymers. As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. One suitable type of cellulosic polymer herein has an average molecular weight of from about 5,000 to about 2,000,000, preferably from about 50,000 to about 1,000,000.

The cellulosic polymer for use herein is preferably of the following formula:

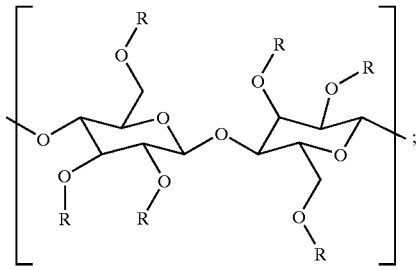

wherein each R is selected from the group consisting of $R_2$, $R_C$, and

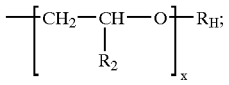

wherein:

each $R_2$ is independently selected from the group consisting of H and $C_1$–$C_4$ alkyl;

each $R_c$ is

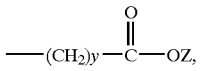

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alklyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, $C_6$–$C_{12}$ aryloxy-2-hydroxyalkyl,

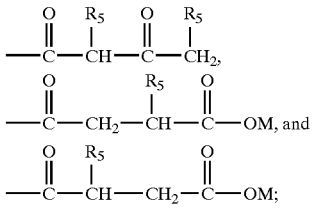

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)$3N-alkyl;

wherein:

M is a suitable cation preferably selected from the group consisting of Na, K, 1/2 Ca, and 1/2 Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous glucose unit, wherein an anhydrous glucose unit is a six membered ring as shown in the repeating unit of the general structure above. The requirement that Z be H or M is necessary to insure that there are a sufficient number of carboxy methyl groups such that the resulting polymer is soluble. It is understood that in addition to the required number of $R_C$ components wherein Z is H or M, there can be, and most preferably are, additional $R_C$ components wherein Z is a group other than H or M.

These polymers can for example be obtained by use of processes as described in co-pending application PCT/US98/19139 and PCT/US98/19142.

Highly preferred modified cellulosic polymers herein have the following specific parameters, varying per polymer, and the following general parameters, applicable to each of these highly preferred polymers.

General Polymer Parameters

| Molecular Parameters | Description |
|---|---|
| Polymer Backbone | Carboxymethylcellulose |
| Degree of Carboxymethylation | $DS_{RC}$ = 0.3–2.0; preferred $DS_{RC}$ = 0.5–0.70. |
| Distribution of Carboxymethyls | Even and random distribution of carboxymethyls along the backbone |
| Molecular Weight | Mw: 5,000–2,000000. Preferred: medium (approx 250,000 g/mol) |
| Type of Modification | Ether modification (in addition to carboxymethylation). Mixed cellulose ether |
| Level of Modification | $DS_{RH}$ = about 0.001 to about 0.1 |

Specific Polymer Parameters

| ID | Polymer | Type of Modification*** | Preferred method of making |
|---|---|---|---|
| *A | Hexyl CMC | Hexyl ether | Chlorohexane added to CMC making process |
| *B | Decyl CMC | Decyl ether | Chlorodecane added to CMC making process |
| ** C | C12–C13 alkoxy-2 hydroxypropyl CMC | C12–C13 alkoxy-2 hydroxypropyl ether | C12–C13 alkyl glycidyl ether added to CMC making process |
| *D | Hexadecyl CMC | Hexadecyl ether | Chlorohexadecane added to CMC making process |

-continued

Specific Polymer Parameters

| ID | Polymer | Type of Modification*** | Preferred method of making |
|---|---|---|---|
| *E | Chloride salt of 3-trimethylammonio-2-hydroxypropyl ether of CMC | chloride salt of 3-trimethylammonio-2-hydroxy-propyl ether | 2,3-epoxypropyltrimethyl ammonium chloride added to the CMC making process |
| *F | [—C(O)—CH(C16H33)—C(O)CH2(C16H33)] ester of CMC or 1,3-dioxo-2-hexadecyloctadecyl ester of CMC | | Cetyl Ketene Dimer added to CMC making process. |

CMC = Carboxymethylcellulose
*Manufactured by Metsa Specialty Chemicals
**Manufactured by Akzo
***$DS_{RH}$ for these materials was in the range of from about 0.001 to about 0.1

Detergent Compositions and Components

The hydrophobically modified cellulosic material may be included in the detergent composition or components herein in the form of separate particles of the particle size specified herein, so-called dry-adds, which consisting essentially of the polymeric material.

The hydrophobically modified cellulosic material may also be present in a premix with other detergent active ingredients, and/or in the form of preformed particles comprising the material and other detergent active ingredients.

The premix herein may be any pre-mix formed by mixing the cellulosic material and one or more other detergent ingredients together.

Suitable pre-formed particles herein, can be formed mixing the cellulosic material with other ingredients, and then by spraying, agglomeration, marumerisation, extrusion or compaction of the mixture, all of which methods for combining detergent ingredients are well-known in the art. Particularly preferred preformed particles are powders obtained from spray-drying processes, agglomerates and extrudates. Suitable spray-drying processes for forming such preformed particles are described for example in EP-A-763594 or EP-A-437888. Suitable processes for forming preformed particles which are agglomerates are described for example in copending application U.S. Ser. No. 60/113,306, but also in WO93/25378, EP-A-367339, EP-A420317 or EP-A-506184 and suitable processes for forming preformed particles by extrusion are described for example in WO91/02047.

The preformed particle or premixes preferably comprise a carrier material and/or a binding material, preferably including a surfactant.

This binding material can be any ingredient capable of binding or sticking the ingredients together. Highly preferred binding materials are surfactants, in particular anionic and nonionic surfactants. Most preferably at least an anionic surfactant is present Suitable surfactants are described herein after. Other binding materials include polyethylene glycols, polyvinyl acetyl amines, polyacrylates an/or maleates, polyvinyl pyrrolidones and derivatives thereof, or mixes thereto.

The carrier material can be any particulate ingredient. Useful particulate materials including inorganic or organic acids or salts and builder materials such a silicates. In particular useful carrier materials include sulphate salts, phosphate salts, carbonate salts, bicarbonate salts, inorganic peroxygen salts, organic carboxylic acids and salts thereof, amorphous silicates, crystalline (layered) silicates, aluminosilicates and mixtures thereof. Preferably at least an aluminosilicate is present.

Other Detergent Ingredients

The compositions or components in accord with the invention also contain additional detergent components. The precise nature of these additional components, and levels of incorporation thereof will depend on the physical form of the composition or component, and the precise nature of the washing operation for which it is to be used.

They preferably contain at least a surfactant and a builder, preferably also one or more additional detergent ingredients selected from additional surfactants and builders, bleaches, bleach catalysts, alkalinity systems, organic polymeric compounds, enzymes, suds suppressors, lime soap, dispersants, soil suspension and anti-redeposition agents soil releasing agents, perfumes, brightners, photobleaching agents, fabric softening agents, such as clays and cationic softeners, additional fabric care agents, and additional corrosion inhibitors.

Preferred additional ingredients are cyclic amine based polymers as described in co-pending application PCT/US98/19143 and PCT/US98/19141, which can provide additional fabric integrity benefits, in particular those compounds described therein in the examples, in particular example 1 and 2. These polymers may be present at a level of from 0.01% to 10% by weight of the composition or component, more preferably at a level of from 0.05% to 5% by weight or even form 0.1% to 2% by weight of the composition, or at a level of from 0.05% to 30% by weight of the component, more preferably at a level of from 0.1% to 20% by weight or even form 0.3% to 10% by weight of the component.

It may be preferred that when the hydophobically modified polymeric material is present in an preformed particle, that the cyclic Amine based polymers or part thereof, are present in the same preformed particle.

Surfactant

The components or compositions in accord with the invention preferably contain one or more surfactants selected from anionic, nonionic, cationic, ampholytic, amphoteric and zwitterionic surfactants and mixtures thereof.

Anionic Surfactant

The components or compositions in accord with the present invention preferably comprise at least an anionic surfactant. Essentially any anionic surfactants useful for detersive purposes can be comprised in the detergent components or compositions.

These can include salts (including, for example, sodium, potassium, ammonium, and substituted ammonium salts such as mono-, di- and triethanolanie salts) of the anionic sulfate, sulfonate, carboxylate, including alkyl ethoxy carboxyletes and soaps, and sarcosinate surfactants. Anionic sulfate and sulfonate surfactants are preferred.

Also preferred are dianionic suriacants containing, preferably two sulphate or sulphontae groups or a sulphate and sulphonate group.

Highly preferred are surfactants systems comprising a sulfonate and a sulfate surfactant, preferably a linear or branched alkyl benzene sulfonate and alkyl sulphates and/or alkyl ethoxylsulfats as described herein.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanonic acid and 2-pentyl-1-heptanoic acid. Certain soaps may also be included as suds suppressers.

Other anionic surfactants include N-acyl sarcosinates, isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters). Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfites, the $C_5$–$C_{17}$ acyl-N—($C_1$–$C_4$ alkyl) and —N—($C_1$–$C_2$ hydroxyalkyl) glucamine sulfates, and sulfates of alkylpolysascharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10-C18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycatboxylic acids, alkyl glycerol sulfonates, fatty acyl glycerol sulfonates, fatty oleyl glycerol sulfonates, and any mixtures thereof.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/ propoxylate condensates with propylene glycol and the nonionic ethoxylate condensation products with propylene oxidelethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl $C_1$–$C_4$ hydroxyalkyl, and —$(C_2H_4O)_xH$, where x is in the range of from 1 to 3.

Nonionic Alkylpolysaccharide Surfactant

Suitable alkylpolysarcharides for use herein are disclosed in U.S. Pat. No. 4,565,647, Llenado, issued Jan. 21, 1986, having a hydrophobic group containing from 6 to 30 carbon atoms and a polysaccharide, e.g, a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Cationic Surfactants

It may be preferred to include cationic surfactants in the compositions or components herein. Preferred are quaternary ammonium surfactants.

The levels of the quaternary ammonium surfactants used in detergent compositions of the invention are preferably from 0.1% to 20%, preferably from 0.4% to 7%, most preferably from 0.5% to about 5.0%, by weight of the detergent composition. The levels of the quaternary ammonium surfactants in components or additives of the invention are preferably from 0.1% to 90%, preferably from 0.5% to 50%, most preferably from 2% to about 30%, by weight of the detergent component or additive.

Preferably, the cationic surfactant herein is selected from the group consisting of cationic mono-alkoxylated amine surfactants, cationic bis-alkoxylated amine surfactants and mixtures thereof. Preferred are salts of the cationic $C_{12}$–$C_{14}$ alkyl dimethyl ammonium ethanol surfactant.

Softener Compounds

Preferably, the compositions or components herein comprise one or more softening compound. Preferred are clays, such as bentonite clay.

Also useful are quaternary ammonium softening compounds having one or two C12–C24 alkyl or alkenyl chains, optionally substituted with one or more functional groups such as —OH, —O—, CONH, —COO—, and with two or three C1–C11, preferably C–$C_6$ or even C1 to C4 alkyl or alkenyl groups, optionally substituted with a functional groups such as —OH, —O—, CONH, —COO— or mixtures thereof. Preferably, they are di-long-chain amides as disclosed in EP-B-0 242 919. Preferably, when comprising two C12–C24 groups, they comprise two C1–C4 groups, preferably methyl or ethyl groups. When the softeners comprise three C1–C11 alkyl or alkenyl groups, they preferably comprise an C18–C24 alkyl or alkenyl group. The anion is preferably chloride or bromide. Other preferred cationic softeners are for example described in U.S. Pat. No. 5,540,850.

Perhydrate Bleaches

An preferred additional components of the components or compositions is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid Potassium peroxymonopersulfate, sodium per is another optional inorganic perhydrate salt of use in the detergent components or compositions herein.

Organic Peroxyacid Bleaching System

A preferred feature of the components or compositions is an organic peroxyacid bleaching system. In one preferred execution the bleaching system contains a hydrogen peroxide source and an organic peroxyacid bleach precursor compound or a preformed peroxyacid or mixtures thereof. When a preformed peroxyacid is present, it may be preferred to use only reduced levels of hydrogen peroxide sources or even omit any hydrogen peroxide source. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the components or compositions. Components or compositions containing mixes of a hydrogen peroxide source and organic peroxyacid precursor in combination with a preformed organic peroxyacid are also envisaged.

Peroxyacid bleach precursors are compounds which react with hydrogen peroxide in a perhydrolysis reaction to pro duce a peroxyacid. Generally peroxyacid bleach precursors may be represented as

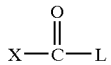

where L is a leaving group and X is essentially any functionality, such that on perhydroloysis the structure of the peroxyacid produced is

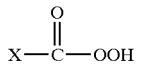

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Preferred alkyl percarboxylic precursor compounds of the imide type include the N,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide substituted alkyl peroxyacid precursor compounds are suitable herein, including those of the following general formulae:

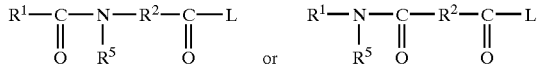

herein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

The detergent composition may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

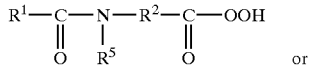

-continued

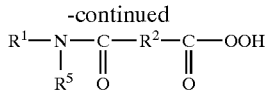

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid Mono- and diperazelaic acid, mono- and dipeibrassylic acid and N-phthaloylaminoperoxicaproic acid are also suitable herein.

Water-soluble Builder Compound

The components or compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent components or compositions of the invention preferably comprise phosphate-containing builder material. Preferably present at a level of from 0.5% to 60%, more preferably from 5% to 50%, more preferably from 8% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing. The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tettacarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

Suitable examples of water-soluble phosphate builders are the alkali metal tripolyphosphates, sodium, potassium and aminonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The components or compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates.

Suitable aluminosilicate zeolites have the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof Zeolite A has the formula:

$$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276H_2O$.

Another preferred aluminosilicate zeolite is zeolite MAP builder.

The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Other preferred builder material includes crystalline layered silicates, such as sodium SKS-6, available from Clariant.

Heavy Metal Ion Sequestrant

The components or compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri(methylene phosphonate)hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion scquestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, asparic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium or substituted ammonium salts thereof, or mixtures thereof.

Enzyme

Another preferred ingredient useful in the components or compositions herein is one or more additional enzymes.

Preferred additional enzymatic materials include the commercially available lipases, cutinaes, ainylases, neutral and alkaline proteases, cellulases, endolases, esterases, pectinases, lactases and peroxidases conventionally incorporated into detergent components or compositionss. Suitable enzymes are discussed in U.S. Pat. Nos. 3,519,570 and 3,533,139.

Preferred commercially available protease enzymes include those sold under the tradenzmes Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of *B licheniformis*, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenises* or *Pseudomas fluorescens*. Lipase from chemically or genetically modified mutants of these stains are also useful herein. A preferred lipase is derived from *Pseudomonas pseudoalcalisenes*, which is described in Granted European Patent, EP-B-0218272.

Another preferred lipase herein is obtained by cloning the gene from *Humicola lanuenosa* and expressing the gene in *Aspergullus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Additional Organic Polymeric Compound

In addition to the hydrophobically modified cellulosic material herein, additional organic polymeric compounds are preferred, preferably present as components of any particulate components where they may act such as to bind the particulate component together. By organic polymeric compound it is meant herein essentially any polymeric organic compound commonly used as dispersants, and anti-redeposition and soil suspension agents in detergent components or compositionss, including quaternised ethoxylated (poly) amine claysoil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol particularly those having an average molecular weight of from 5,000 to 10,000, are also suitable herein.

Other preferred additional organic polymeric compounds suitable for incorporation in the detergent components or compositionss herein include additional non-hydrophobically modified cellulose derivatives such as methylcellulose, carboxymethylcellulose, hydroxypropyhnethylceliulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415.807, Gosselink et al., and in particular according to U.S. application Ser. No. 60/051,517.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

Polymeric Dye Transfer Inhibiting Agents

The compositions herein may preferably also comprise from 0.01% to 10%, preferably from 0.05% to 0.5% by weight of polymeric dye transfer inhibiting agents, preferably selected from polyamine N-oxide polymers, copolymers of N-vinylpyrrolidone and N-vinylimidazole, polyvinylpyrrolidonepolymers or combinations thereof whereby these polymers can be cross-linked polymers.

Optical Brightener

The compositions herein also optionally contain from about 0.005% to 5% by weight of certain types of hydrophilic optical brighteners.

Other Optional Ingredients

Other optional ingredients suitable for inclusion in the components or compositions of the invention include perfumes, colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

Form of the Components or Compositionss

The components or compositions herein can take a variety of physical forms including liquid and solid forms such as tablet, flake, pastilie and bar, and preferably granular forms. The components or compositions can be made via a variety of methods, depending on their product form. The solid compositions or components can be made by methods such as dry-mixing, agglomerating, compaction, or spray-drying of the various compounds comprised in the detergent component, or mixtures of these techniques.

Detergent compositions and components herein preferably have a bulk density of from 300 g/liter or even 350 g/liter or 450 g/liter to preferably 1500 g/liter or 100 g/liter or even to 850 g/liter.

Fabric Laundering Method

The present invention also provides a method for laundering. Such a method employs contacting these fabrics with an aqueous washing solution formed from an effective amount of the detergent components or compositions herein before described or formed from the individual components of such components or compositions. Contacting of fabrics with washing solution will generally occur under conditions of agitation although the components or compositions of the present invention may also be used to form aqueous unagitated soaking solutions for fabric cleaning and treatment. As discussed above, it is preferred that the washing solution have a pH of less than about 11.0, preferably it has a pH of less than 10.5 and most preferably it has a pH of less than 9.5.

An effective amount of a high density liquid or granular detergent components or compositions in the aqueous wash solution in the washing machine is preferably from about 500 to about 10000 ppm or even 7000 ppm, more preferably from about 1000 to about 3000 ppm.

The detergent components or compositions herein may also be used to treat and condition fabrics and textiles. Thus, for example, a fabric conditioning components or compositions comprising the hydrophobically modified cellulosic materials as described herein, may be added during the rinse cycle of a conventional home laundering operation in order to impart the desired fabric appears and integrity benefits hereinbefore described. Then, preferably at least about 1%, preferably from about 10%, more preferably from about 20% to about 80%, more preferably to about 60% by weight, of the composition or component is one or more fabric softener actives, such as catonically charged hydrocarbons, such as C12–C22 dialkyl substitued quaternary ammonium salts and/or clays, optionaly with a flocculating polymer.

Alternatively, the composition or component herein may be present in or in the form of a softening and cleaning composition, such as for example described in EP-B1-313146 and WO93/01267, preferably comprising additional softening ingredients, such as clay and optionally a flocculating polymer.

Abbreviations Used in the Detergent Composition Examples

LAS: Sodium linear C11–13 alkyl benzene sulfonate

TAS: Sodium tallow alkyl sulfate

CxyAS; Sodium Clx–Cly alkyl sulac

CxyEzS: Sodium Clx–Cly alkyl sulfate condensed with z moles of ethylene oxide

CxyEz: Clx–Cly predominantly linear primary alcohol condensed with an average of z moles of ethylene oxide QAS: R2.N+(CH3)2(C2H4OH) with R2=C12–$C_{14}$ alkyl QASA: R2.R3.N+(CH3)2 with R2 and R3 independently being C12–C24 alkyl Soap: Sodium linear alkyl carboxylate derived from an 80/20 mixture of tallow and coconut fatty acids STS: Sodium toluene sulphonate CFAA: C12–C14 (coco) alkyl N-methyl glucarnide TFAA: C16–C18 alkyl N-methyl glucamide TPKFA: C12–C14 topped whole cut fatty acids STPP: Anhydrous sodium tripolyphosphate TSPP: Tetasodium pyrophosphate Zeolite A: Hydrated sodium aluminosilicate of formula Na12(AlO2SiO2)12.27H2O having a primary particle size in the range from 0.1 to 10 micrometers (weight expressed on an anhydrous basis)

NaSKS-6: Crystalline layered silicate of formula d-Na2Si2O5

Malic acid: Anhydrous malic acid

Malcic acid: Anhydrous maleic acid

Tartaric acid: Anhydmus tartaric acid

Carbonate: Anydrous sodium carbonate

Bicarbonate: Anhydrous sodium bicarbonate

Silicate: Amorphous sodium silicate (SiO2:Na2O=2.0:1)

Sulfate: Anhydrous sodium sulfate

Mg sulfate: Anhydrous magnesium sulfate

Citrate: Tri-sodium citrate dihydrate of activity 86.4% with a particle size distribution between 425 $\mu$m and 850 $\mu$m MA/AA: Copolymer of 1:4 maleic/acrylic acid, average molecular weight about 70,000

MA/AA (1): Copolymer of 4:6 maleic/acrylic acid, average molecular weight about 10,000

AA: Sodium polyacrylate polymer of average molecular weight 4,500

CABP: Cyclic amine based polymer as described in PCT/US98/19143 and PCT/US98/19141 in examples 1 and 2 in table HMC I: Hydrophobically modified cellulosic material comprising one or more of the polymers numbered A to F, described in the tables on p.6–7, whereof 80% by weight has a particle size of from 10 to 450 microns HMC II: Hydrophobically modified cellulosic material comprising one or more of the polymers numbered A to F, described in the tables on p.6–7, whereof 80% by weight has a particle size of from 350 to 850 microns AC: Hydrophobically modified amide cellulose having an amide group comprising 2 to 12 carbon atoms CMC: Sodium carboxymethyl cellulose Cellulose ether: Methyl cellulose ether with a degree of polymerization of 650 available from Shin Etsu Chemicals PB4: Particle containing sodium perborate tetrahydrate of nominal formula NaBO2.3H2O PB1: Particle containing anhydrous sodium perborate bleach of nominal formula NaBO2.H2O2

Percarbonate: Particle containing sodium percarbonate of nominal formula 2Na2CO3.3H2O2

NOBS: Particle comprising nonanoyloxybenzene sulfonate in the form of the sodium salt, the particles having a weight average particle size of 750 microns to 900 microns NAC-OBS: Particle comprising (6-nonamidocaproyl) oxybenzene sulfonate, the particles having a weight average particle size of from 825 microns to 875 microns TAED: Tetraacetylethylenediamine DTPA: Diethylene triamine pentaacetic acid DTPMP: Diethylene triamine penta (methylene phosphonate), marketed by Monsanto under the Trade-name Dequest 2060

Brightener: Disodium 4,4'-bis(2-sulphostyryl)biphenyl or disodium 4,4'-bis(4-anilino-6-morpholino-1.3.5-triazin-2-yl)amino)stilbene-2:2'-disulfonate EDDS: Ethylenediamine-N,N'-disuccinic acid, (S,S) isomer in the form of its sodium salt.

HEDP: 1,1-hydroxyethane diphosphonic acid

PEGx: Polyethylene glycol, with a molecular weight of x (typically 4,000)

PEO: Polyethylene oxide, with an average molecular weight of 50,000

PVI: Polyvinyl imidosole, with an average molecular weight of 20,000

PVP: Polyvinylpyilidone polymer, with an average molecular weight of 60,000

PVNO: Polyvinylpyridine N-oxide polymer, with an average molecular weight of 50,000

PVPVI: Copolymer of polyvinylpyrolidone and vinylimidazole, with an average molecular weight of 20,000

QEA: bis((C2H5O)(C2H4O)n)CH3)-N+—$C_6$H12-N+—CH3) bis((C2H5O)—(C2H4O))n, wherein n=from 20 to 30

SRP: Anionically end capped poly esters

PEI: Polyethyleneimine with an average molecular weight of 1800 and an average ethoxylation degree of 7 ethyleneoxy residues per nitrogen Silicone antifoam: Polydimethylsiloxane foam controller with siloxane-oxyalkylene copolymer as dispersing agent with a ratio of said foam controller to said dispersing agent of 10:1 to 100:1

In the following examples all levels are quoted as % by weight of the composition:

Examples of preformed particles G to J comprising any of the HMC I:

| Particle: | G | H | I | J |
|---|---|---|---|---|
| HMC I | 14.0 | 3.0 | 5.0 | 10.0 |
| CABP | 6.0 | — | — | — |
| Zeolite | — | 33.0 | 25 | 30.0 |
| Water | 10.0 | — | 6.0 | 10.0 |
| LAS or AS | 40.0 | 20.0 | — | 20.0 |
| AE3, AE5 or AE7 | — | — | — | — |
| PVNO or PVP | — | — | 34 | — |
| AA or MA/AA | 27.0 | 20.0 | — | — |
| Brightener | — | — | | 5.0 |
| Sodium Carbonate | — | 24.0 | 25.0 | 15.0 |
| CMC/PEG | 3.0 | — | 5.0 | — |
| total | 100.0 | 100.0 | 100.0 | 100.0 |

TABLE III

The following compositions are in accordance with the invention.

| | N | O | P | Q | R | S | T | U | V |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| MBAS | — | — | | 5.0 | 5.0 | | — | — | — |
| $C_{45}$AS | — | — | 1.0 | | 2.0 | 2.0 | — | — | — |
| $C_{45}AE_3S$ | — | — | | 1.0 | | | — | — | — |
| QAS | 1.0 | 1.5 | 1.0 | 1.0 | 0.5 | 0.8 | — | — | — |
| HMC I | 0.3 | 0.8 | 1.5 | 1.0 | 0.9 | 1.3 | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}$AS | — | — | — | — | — | — | 2.0 | — | — |
| $AE_3$ | — | — | — | — | — | — | — | 1.0 | 0.5 |
| Carbonate | — | — | — | — | — | — | 1.0 | 1.0 | — |
| Sodium citrate | — | — | — | — | — | — | — | — | 5.0 |
| CFAA | — | — | — | — | — | — | — | — | — |
| Citric acid | — | — | — | — | — | — | — | 1.0 | 1.0 |
| QEA | — | — | — | — | — | — | 2.0 | — | — |
| SRP | — | — | — | — | — | — | 1.0 | 0.2 | — |
| Zeolite A | — | — | — | — | — | — | 26.0 | 15.0 | 16.0 |

TABLE III-continued

The following compositions are in accordance with the invention.

| | N | O | P | Q | R | S | T | U | V |
|---|---|---|---|---|---|---|---|---|---|
| Sodium silicate | — | — | — | — | — | — | — | — | — |
| PEG | — | — | — | — | — | — | 4.0 | — | — |
| HMC I | — | — | — | — | — | — | 5.0 | — | — |
| Builder Agglomerates | | | | | | | | | |
| SKS-6 | — | — | — | — | — | 3.0 | — | 7.0 | 10.0 |
| LAS | — | — | — | — | — | 3.0 | — | 10.0 | 12.0 |
| Dry-add particulate components | | | | | | | | | |
| Any of Particle G to J | — | — | — | — | 10.0 | 5.0 | — | 2.0 | 4.0 |
| NACAOBS | 3.0 | — | — | 4.5 | — | — | — | 2.5 | — |
| NOBS | 1.0 | 3.0 | 3.0 | — | — | — | — | — | 5.0 |
| TAED | 2.5 | — | — | 1.5 | 2.5 | 6.5 | — | 1.5 | — |
| Citrate/citric acid | — | — | — | 4.0 | — | 5.0 | — | — | 5.0 |
| Percarbonate | 15.0 | 3.0 | 6.0 | 10.0 | — | — | 24.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | — | 0.5 | 0.5 | — | 0.3 | — | 0.2 | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| HMC II | 1.0 | 0.5 | — | — | — | — | — | — | — |
| Dyed carbonate (blue, green) | 0.5 | 0.5 | 1.0 | 2.0 | — | 0.5 | 0.5 | 0.5 | 1.0 |
| Spray-on | | | | | | | | | |
| Brightener | 0.2 | 0.2 | 0.3 | 0.1 | 0.2 | 0.1 | — | 0.6 | 0.3 |
| Dye | — | — | — | 0.3 | 0.05 | 0.1 | — | — | — |
| AE7 | — | — | — | — | — | 0.5 | — | 0.7 | — |
| Perfume | 1.0 | 0.5 | 1.1 | 0.8 | 0.3 | 0.5 | 0.3 | 0.5 | — |
| Fillers up to 100% | | | | | | | | | |

TABLE IV

The following compositions are in accordance with the invention.

| | W | X | Y | Z | AA | BB | CC | DD | EE |
|---|---|---|---|---|---|---|---|---|---|
| Spray-Dried Granules | | | | | | | | | |
| LAS | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | 1.0 | 0.8 | 1.0 | 1.0 | 2.0 | 4.0 | — | — | — |
| DTPA, HEDP and/or EDDS | 0.3 | 0.3 | 0.3 | 0.3 | — | — | — | — | — |
| MgSO4 | 0.5 | 0.4 | 0.1 | — | | | — | — | — |
| Sodium citrate | 10.0 | 12.0 | — | 3.0 | — | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| HMC I | 0.5 | 1.2 | 2.0 | — | — | — | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}AS$ | — | — | — | — | — | — | 2.0 | — | — |
| CABP | — | — | — | — | — | 1.0 | 0.2 | — | 0.5 |
| Carbonate | — | — | — | — | — | 1.0 | 1.0 | 1.0 | — |
| Sodium citrate | — | — | — | — | — | — | — | — | 5.0 |
| CFAA | — | — | — | | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |

TABLE IV-continued

The following compositions are in accordance with the invention.

| | W | X | Y | Z | AA | BB | CC | DD | EE |
|---|---|---|---|---|---|---|---|---|---|
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| HMC I | | | | | | | 3.0 | | |
| Dry-add particulate components | | | | | | | | | |
| Any of Particle G to J | — | — | 4.0 | — | 6.0 | 5.0 | — | — | — |
| NACAOBS | 3.0 | — | — | 1.5 | — | — | — | 5.5 | — |
| NOBS/LOBS/DOBS | — | 3.0 | 3.0 | — | — | — | — | — | 5.0 |
| TAED | 2.5 | — | — | 1.5 | 2.5 | 6.5 | — | 1.5 | — |
| HMC II | — | — | — | 0.7 | — | — | 1.0 | 3.5 | 0.5 |
| QEA | — | — | — | 0.2 | 0.5 | — | — | — | — |
| Percarbonate | 15.0 | 3.0 | 6.0 | 10.0 | — | — | 12.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | — | — | — | — | 5.0 | 5.0 |
| Dyed carbonate (blue, green) | 0.5 | 0.5 | ? | 2.0 | — | 0.5 | 0.5 | 0.5 | 1.0 |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | 0.8 | 0.5 | 1.0 |
| Fillers up to 100% | | | | | | | | | |

TABLE V

The following are high density and bleach-containing detergent formulations according to the present invention:

| | FF | GG | HH |
|---|---|---|---|
| Agglomerates | | | |
| STPP/Zeolite A | 10.0 | 25.0 | 15.0 |
| QAS | — | 2.5 | — |
| LAS | 3.0 | — | 3.0 |
| C45AS | 3.0 | 2.0 | 4.0 |
| QAS | — | — | 1.5 |
| DTPMP | 0.4 | 0.4 | 0.4 |
| CMC | 0.4 | 0.4 | 0.4 |
| MA/AA | 4.0 | 2.0 | 2.0 |
| HMC | 2.0 | — | 1.5 |
| CABP | 0.8 | 1.0 | 0.5 |
| Agglomerate | | | |
| NaSKS-6 (I) or (II) | 15.0 | — | — |
| LAS | 8.0 | — | — |
| AS | 5.0 | — | — |
| Spray On | — | | |
| Perfume | 0.3 | 0.3 | 0.3 |
| C25E3 | 2.0 | — | 2.0 |
| brightener | 0.1 | 0.4 | |
| photobleach | 0.03 | 0.05 | — |
| Dry additives | | | |
| QEA | 1.0 | 2.0 | — |
| Citric acid | 5.0 | — | 2.0 |
| Any of Particle G - J | — | 7.0 | |
| Carbonate | 8.0 | 15.0 | 10.0 |
| NAC OBS | 6.0 | — | 5.0 |
| HMC II | — | — | 2.0 |
| TAED | | 3.0 | — |
| NOBS | — | 2.0 | — |

TABLE V-continued

The following are high density and bleach-containing detergent formulations according to the present invention:

| | FF | GG | HH |
|---|---|---|---|
| Percarbonate | — | 7.0 | 10.0 |
| Polyethylene oxide of MW 5,000,000 | — | — | 0.2 |
| Bentonite clay | — | — | 10.0 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| CMC | 1.0 | 0.5 | 1.0 |
| Balance (Moisture and Miscellaneous) | 100.0 | 100.0 | 100.0 |
| Density (g/liter) | 850 | 850 | 850 |

TABLE VI

The following liquid composition is in accord with the invention

| Component | II | JJ | KK | LL |
|---|---|---|---|---|
| $C_{12-15}$ alkyl ether (2.5) sulfate | 38 | 38 | 38 | 38 |
| $C_{12}$ glucose amide | 6.86 | 6.86 | 6.86 | 6.86 |
| Citric Acid | 4.75 | 4.75 | 4.75 | 4.75 |
| $C_{12-14}$ Fatty Acid | 2.00 | 2.00 | 2.00 | 2.00 |
| Enzymes | 1.02 | 1.02 | 1.02 | 1.02 |
| MEA | 1.0 | 1.0 | 1.0 | 1.0 |
| Propanediol | 0.36 | 0.36 | 0.36 | 0.36 |
| Borax | 6.58 | 6.58 | 6.58 | 6.58 |

TABLE VI-continued

| The following liquid composition is in accord with the invention | | | | |
|---|---|---|---|---|
| Component | II | JJ | KK | LL |
| Dispersant | 1.48 | 1.48 | 1.48 | 1.48 |
| Na Toluene Sulfonate | 6.25 | 6.25 | 6.25 | 6.25 |
| QAS | 1.0 | 1.0 | — | 1.0 |
| QEA | 2.0 | 2.0 | 2.0 | — |
| CABP | — | — | 1.0 | 0.5 |
| HMC I or II | 5.0–0.5 | 5.0–0.5 | 5.0–0.5 | 5.0–0.5 |
| CMC or AC | 1.0 | 1.0 | 2.0 | — |
| Dye, Perfume, | Balance | Balance | Balance | Balance |
| Brighteners, Preservatives, Suds Suppressor, Other Minors, Water | | | | |
| | 100% | 100% | 100% | 100% |

TABLE VII

| The following liquid detergent formulations are prepared according to the present invention | | | | | |
|---|---|---|---|---|---|
| | MM | NN | OO | PP | QQ |
| LAS | 11.5 | 9.0 | — | 4.0 | — |
| C25E2.5S | — | 3.0 | 18.0 | — | 16.0 |
| C45E2.25S | 1.5 | 3.0 | — | 16.0 | — |
| C23E9 | — | 3.0 | 2.0 | 2.0 | 1.0 |
| C23E7 | 3.2 | — | — | — | — |
| CFAA | — | — | 5.0 | — | 3.0 |
| TPKFA | 2.0 | — | 2.0 | 0.5 | 2.0 |
| Citric (50%) | 6.5 | 1.0 | 2.5 | 4.0 | 2.5 |
| Ca formate | 0.1 | 0.06 | 0.1 | — | — |
| Na formate | 0.5 | 0.06 | 0.1 | 0.05 | 0.05 |
| STS | 4.0 | 1.0 | 3.0 | 1.2 | — |
| Borate | 0.6 | — | 3.0 | 2.0 | 3.0 |
| Na hydroxide | 6.0 | 2.0 | 3.5 | 4.0 | 3.0 |
| Ethanol | 2.0 | 1.0 | 4.0 | 4.0 | 3.0 |
| 1,2 Propanediol | 3.0 | 2.0 | 8.0 | 8.0 | 5.0 |
| Monoethanolamine | 3.0 | 1.5 | 1.0 | 2.5 | 1.0 |
| HMC I or II | 5.0–0.5 | 5.0–0.5 | 5.0–0.5 | 5.0–0.5 | 5.0–0.5 |
| CABP | 0.5 | 0.5 | — | — | — |
| Protease | 0.03 | 0.01 | 0.03 | 0.02 | 0.02 |
| Lipase | — | — | 0.002 | — | — |
| Amylase | — | — | — | 0.002 | — |
| Cellulase | — | — | 0.0002 | 0.0005 | 0.0001 |
| CMC | 0.2 | — | 0.5 | — | 1.0 |
| DTPA | — | — | 0.3 | — | — |
| PVNO | — | — | 0.3 | — | 0.2 |
| Silicone antifoam | 0.04 | 0.02 | 0.1 | 0.1 | 0.1 |

What is claimed is:

1. A detergent composition or component comprising a dry-added particulate hydrophobically modified cellulosic material, wherein at least 80% of said particulate material has a particle size of below 1000 microns, said material comprising polymers of the formula

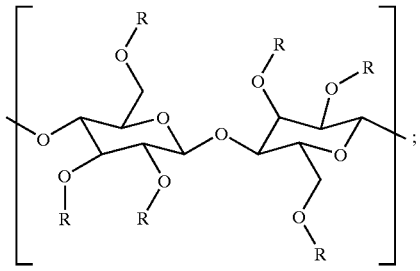

wherein each R is selected from the group consisting of $R_2$, $R_C$, and

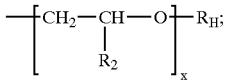

wherein:

each $R_2$ is independently selected from the group consisting of H and $C_1$–$C_4$ alkyl;

each $R_C$

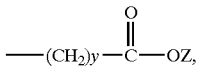

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$ N-alkyl, $(R_4)_3$ N-2-hydroxyalkyl, $C_6$–$C_{12}$ aryloxy-2-hydroxyalkyl,

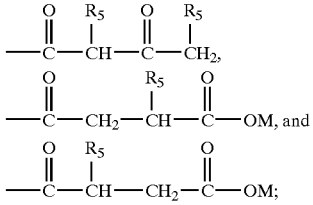

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-aklyl, and $(R_4)_3$ N-alkyl;

wherein:

M is a suitable cation;

each x is from 0 to about 5;

each y is from about 1 to about 5; and provided that:

the Degree of Substitution for group $R_H$ is between about 0.001 and 0.1;

the Degree of Substitution for group $R_C$ wherein Z is H or M is between about 0.2 and 2.0;

if any $R_H$ bears a positive charge, it is balanced by a suitable anion; and two $R_4$'s on the same nitrogen can together form a ring-structure selected from the group consisting of piperidine and morpholine, said particulate cellulosic material further comprising a binder selected from the group consisting of polyacrylate and maleic/acrylic acid copolymer.

2. A composition or component according to claim 1 , wherein each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$ N-alkyl, $(R_4)_3$ N-2-hydroxyalkyl, $C_6$–$C_{12}$ aryloxy-2-hydroxyalkyl, and mixtures thereof.

* * * * *